US005156694A

United States Patent [19]

Yamazaki et al.

[11] Patent Number: 5,156,694

[45] Date of Patent: Oct. 20, 1992

[54] METHOD OF PRODUCING FORMABLE THIN STEEL SHEETS

[75] Inventors: Yoshio Yamazaki; Susumu Okada; Susumu Satoh; Toshiyuki Kato; Hideo Abe; Keiji Nishimura, all of Chiba, Japan

[73] Assignee: Kawasaki Steel Corporation, Kobe, Japan

[21] Appl. No.: 696,683

[22] Filed: May 7, 1991

Related U.S. Application Data

[62] Division of Ser. No. 449,724, Dec. 12, 1989, Pat. No. 5,053,194.

[30] Foreign Application Priority Data

Dec. 19, 1988 [JP] Japan ..... 63-318404
Oct. 26, 1989 [JP] Japan ..... 1-277158

[51] Int. Cl.[5] ..... C21D 8/02

[52] U.S. Cl. ..... 148/603; 148/651; 148/240

[58] Field of Search ..... 148/12 D, 12 C, 12.1, 148/12 F, 651, 603, 240

[56] References Cited

U.S. PATENT DOCUMENTS 4,586,965 5/1986 Obara et al. ..... 148/12 D

*Primary Examiner*—Deborah Yee
*Attorney, Agent, or Firm*—Dvorak and Traub

[57] ABSTRACT

A formable thin steel sheet such as hot rolled sheet, cold rolled sheet or surface treated sheet comprises not more than 0.003 wt % of C, not more than 1.0 wt % of Si, not more than 1.0 wt % of Mn, not more than 0.15 wt % of P, not more than 0.020 wt % of S, not more than 0.0045 wt % of O, not more than 0.0020 wt % of N, not more than 0.15 wt % of Al provided that a ratio of Al/N is not less than 30, and the balance being Fe and inevitable impurities, and has not only improved formability for press forming, deep drawing or the like but also improved fatigue resistance as a welded joint.

5 Claims, 8 Drawing Sheets

METHOD OF PRODUCING FORMABLE THIN STEEL SHEETS

This is a divisional of application Ser. No. 449,724, filed on Dec. 12, 1989, now U.S. Pat. No. 5,053,194.

BACKGROUND OF THE INVENTION

1. Field of the Invention

This invention relates to hot rolled steel sheets, cold rolled steel sheets and surface treated steel sheets having not only improved formability for press forming, deep drawing or the like but also improved fatigue resistance at a welded joint.

2. Related Art Statement

In general, the thin steel sheets are widely used for press forming, deep drawing and the like. However, it is required to have properties in accordance with use purposes in addition to the above formability. For example, the thin steel sheets are frequently subjected to a welding, particularly, spot welding irrespective of cold rolled sheets, hot rolled sheets and surface treated sheets.

Particularly, the thin steel sheet is used for automobiles. In this case, the spot number in the spot welding per one vehicle amounts to several thousand points and also stress concentration is apt to caused in the welded joint portion when a load is applied from exterior. That is, the fatigue breakage through the repetition of such a stress concentration during the running of the vehicle is caused in the welded joint portion, resulting in the occurrence of serious accidents. In the formable thin steel sheet, therefore, the fatigue resistance of the welded joint is a very important characteristic.

On the other hand, extreme-low carbon steels having a formability higher than that of the conventional low carbon steel are frequently used for the thin steel sheet. However, the fatigue strength of the extreme-low carbon steel may be lowered due to poor texture of heat-affected zone in the welded joint in accordance with the conditions.

Moreover, it is demanded to more improve the safety of machines and structures such as automobiles and the like as a worldwide theme, and consequently it becomes significant to enhance the fatigue strength of the welded joint as compared with the case of using the conventional steel sheets.

In this connection, there are proposed various steel sheets in Japanese Patent laid open No. 54-135616, No. 53-52222, No. 61-246344, No. 58-25436, No. 53-137021, No. 58-110659 and the like. However, all of these techniques disclose the mechanical properties of the cold rolled steel sheet but are silent in the fatigue strength of the welded joint.

Furthermore, Japanese Patent laid open No. 63-317625 discloses a method of controlling amounts of Ti, Nb and B to particular ranges for improving the fatigue resistance of the welded joint in the steel sheet. In this method, however, the tensile shear fatigue properties in the spot welded zone are considered, but there is no consideration on the cross tensile fatigue properties. Moreover, Japanese Patent laid open No. 225748 discloses cold rolled steel sheets having excellent fatigue properties, but in this case the fatigue properties of the sheet itself are merely improved.

SUMMARY OF THE INVENTION

It is, therefore, an object of the invention to provide thin steel sheets having not only an improved formability for press forming, deep drawing or the like but also excellent fatigue resistance at welded joints, particularly fatigue resistance in spot welding.

According to a first aspect of the invention, there is the provision of a formable thin steel sheet having an improved fatigue resistance at welded joints, comprising not more than 0.003 wt % of C, not more than 1.0 wt % of Si, not more than 1.0 wt % of Mn, not more than 0.15 wt % of P, not more than 0.020 wt % of S, not more than 0.0045 wt % of O, not more than 0.0020 wt % of N, not more than 0.15 wt % of Al provided that a ratio of Al/N is not less than 30, and the balance being Fe and inevitable impurities.

In a preferred embodiment of the first invention, the steel sheet contains at least one of 0.001–0.025 wt % of Nb and 0.0002–0.0020 wt % of B, or further contains at least one of not more than 0.10 wt % of Ti, not more than 0.10 wt % of V, not more than 0.10 wt % of Zr, not more than 0.10 wt % of Ca, not more than 1.0 wt % of Cr, not more than 1.0 wt % of Cu and not more than 1.0 wt % of Ni.

According to a second aspect of the invention, there is the provision of a method of producing formable thin steel sheets having an improved fatigue resistance at welded joints, which comprises hot rolling a sheet of steel comprising not more than 0.003 wt % of C, not more than 1.0 wt % of Si, not more than 1.0 wt % of Mn, not more than 0.15 wt % of P, not more than 0.020 wt % of S, not more than 0.0045 wt % of O, not more than 0.0020 wt % of N, not more than 0.15 wt % of Al provided that a ratio of Al/N is not less than 30, and the balance being Fe and inevitable impurities at a finish temperature of not lower than 600° C., cold rolling the hot rolled sheet at a rolling reduction of not less than 60% and then subjecting the cold rolled sheet to a recrystallization annealing at a temperature of not higher than $A_{C3}$ transformation point.

In preferred embodiments of the second invention, the hot rolled sheet is coiled at a coiling temperature of not lower than 200° C. after the hot rolling, and the resulting thin steel sheet is subjected to a galvanizing or electroplating.

BRIEF DESCRIPTION OF THE DRAWINGS

The invention will be described with reference to the accompanying drawings, wherein.

DESCRIPTION OF THE PREFERRED EMBODIMENTS

The inventors have aimed at a point that there are less reports on the influence of steel component upon the fatigue properties though the fatigue properties of welded joints in the thin steel sheet are very important even in articles using such steel sheet and made various studies with respect to the influence of steel components on the fatigue properties of the welded joint, particularly fatigue properties of the spot welded joint, and found out the following knowledges.

At first, the invention is described with respect to experimental results leading in the success of the invention. Moreover, the fatigue test for the spot welded joint is carried out by a fatigue test method of the spot welded joint according to JIS Z3138, and the fatigue limit value means an upper limit of loading range when a repeat number of loading applied to the test specimen is 10,000,000 times.

Figure 1:
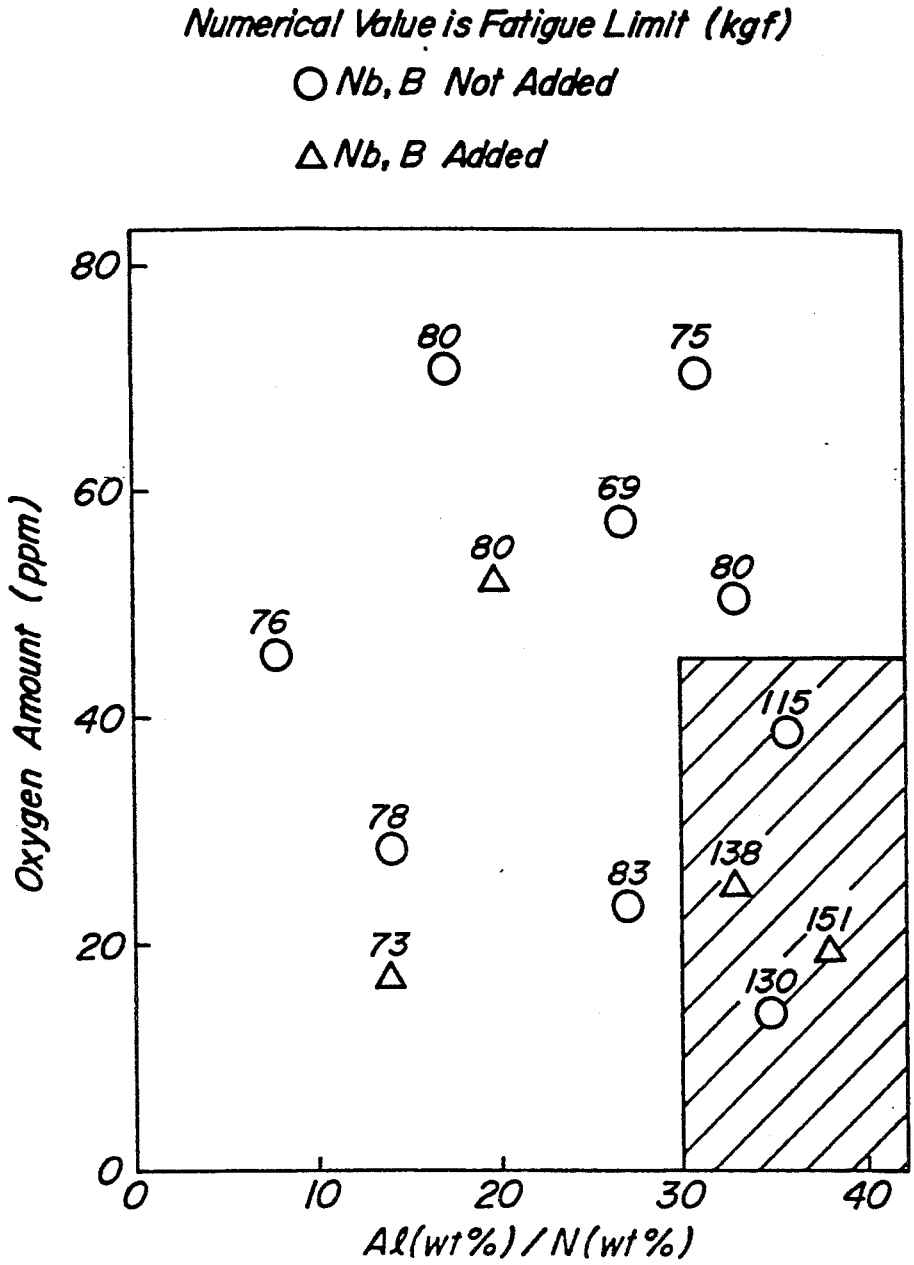
FIG. 1 is a graph showing influence of oxygen amount and Al/N ratio upon the value of tensile shear fatigue limit in the spot welded joint of the cold rolled steel sheet.

In FIG. 1 are shown a relationship among oxygen amount, Al/N ratio and tensile shear fatigue limit value at the spot welded joint in a cold rolled steel sheet of 0.8 mm in thickness. The chemical composition of steels used in the fatigue test is shown in the following Table 1, and the conditions of the spot welding are shown in the following Table 2. Moreover, the steel sheet was hot rolled at a finish temperature of about 900° C., cold rolled at a rolling reduction of 75–80% and continuously annealed at a temperature of 820°–840° C.

In FIG. 1, a shadowed area shows a region that the fatigue limit value is higher by 10% or more than that of the conventional low carbon aluminum killed and box annealed steel sheet (tensile shear fatigue limit: 82 kgf), which corresponds to a region that the oxygen amount is not more than 0.0045 wt % and the Al/N ratio is not less than 30.

TABLE 1

(wt %)

| Kind of steel | C | Si | Mn | P | S | Nb | B |
|---|---|---|---|---|---|---|---|
| Nb, B not added | 0.0009~0.0014 | 0.01 | 0.1 | 0.015 | 0.01 | — | — |
| Nb, B added | 0.0008~0.0013 | 0.01 | 0.1 | 0.015 | 0.01 | 0.003~0.006 | 0~0.0008 |
| low carbon steel* | 0.038 | 0.02 | 0.22 | 0.018 | 0.013 | — | — |

*comparative steel

TABLE 2

| Sample size | | Welding conditions | | | Average nugget |
|---|---|---|---|---|---|
| width (mm) | length (mm) | chip | welding force | welding current | diameter (mm) |
| 40 | 150 | Cr—Cu, 4.8 ϕmm, CF model | 200 kgf | 8.5~9.5 kA | 5.0 |

Figure 2:
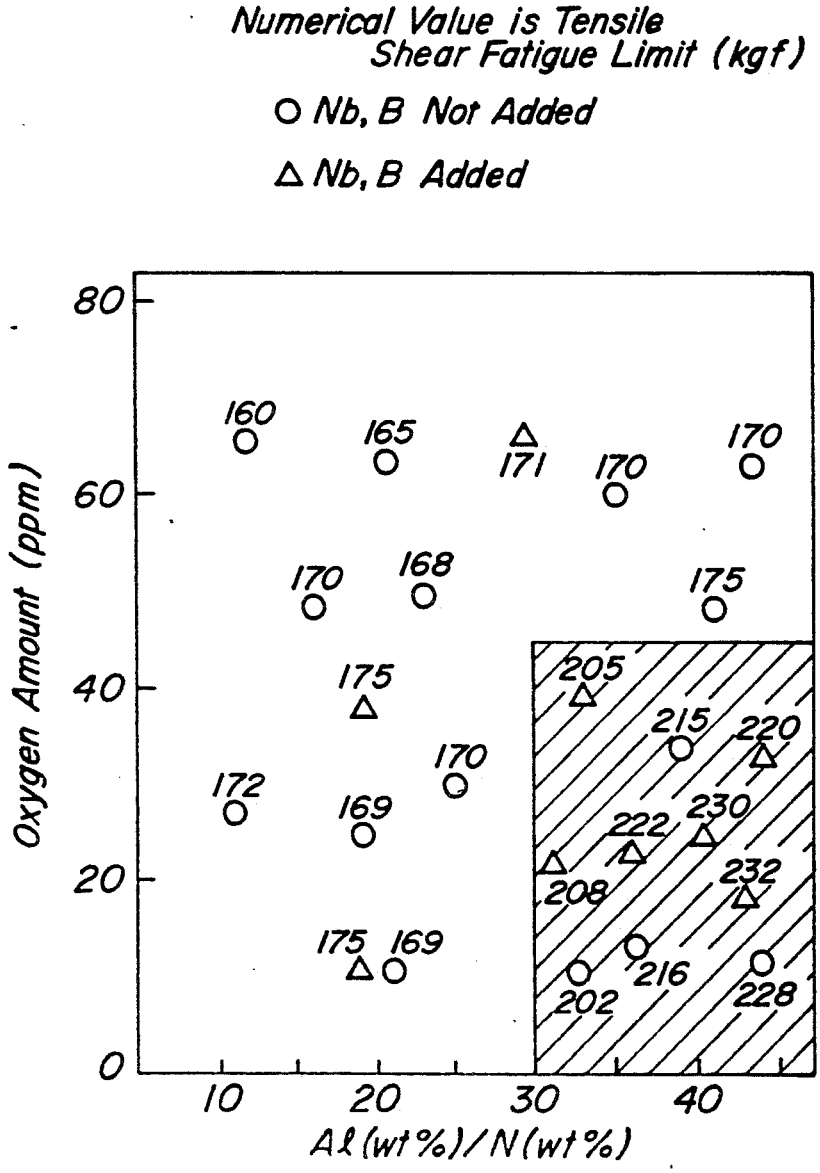
FIG. 2 is a graph showing influences of oxygen amount and Al/N ratio upon the value of tensile shear fatigue limit in the spot welded joint of the hot rolled steel sheet.

In FIG. 2 is shown a relationship among oxygen amount, Al/N ratio and tensile shear fatigue limit value at the spot welded joint in a hot rolled steel sheet of 2.6 mm in thickness. The chemical composition of steels used in the fatigue test is shown in the following Table 3, and the conditions of the spot welding are shown in the following Table 4. Moreover, the steel sheet was hot rolled at a finish temperature of about 900° C. and coiled at a coiling temperature of 550° C.

In FIG. 2, a shadowed area shows a region that the fatigue limit value is higher by 10% or more than that of the conventional low carbon aluminum killed and hot rolled steel sheet (tensile shear fatigue limit: 168 kgf), which corresponds to a region that the oxygen amount is not more than 0.0045 wt % and the Al/N ratio is not less than 30 likewise the case of the cold rolled sheet.

TABLE 3

(wt %)

| Kind of steel | C | Si | Mn | P | S | Nb | B |
|---|---|---|---|---|---|---|---|
| Nb, B not added | 0.0009~0.0015 | 0.01 | 0.1 | 0.015 | 0.01 | — | — |
| Nb, B added | 0.0007~0.0013 | 0.01 | 0.1 | 0.015 | 0.01 | 0.003~0.008 | 0~0.0010 |
| low carbon steel* | 0.032 | 0.02 | 0.25 | 0.018 | 0.013 | — | — |

*comparative steel

TABLE 4

| Sample size | | Welding conditions | | | Average nugget |
|---|---|---|---|---|---|
| width (mm) | length (mm) | chip | welding force | welding current | diameter (mm) |
| 50 | 180 | Cr—Cu, 9 ϕmm, CF model | 650 kgf | 12~14 kA | 10.0 |

Figure 3:
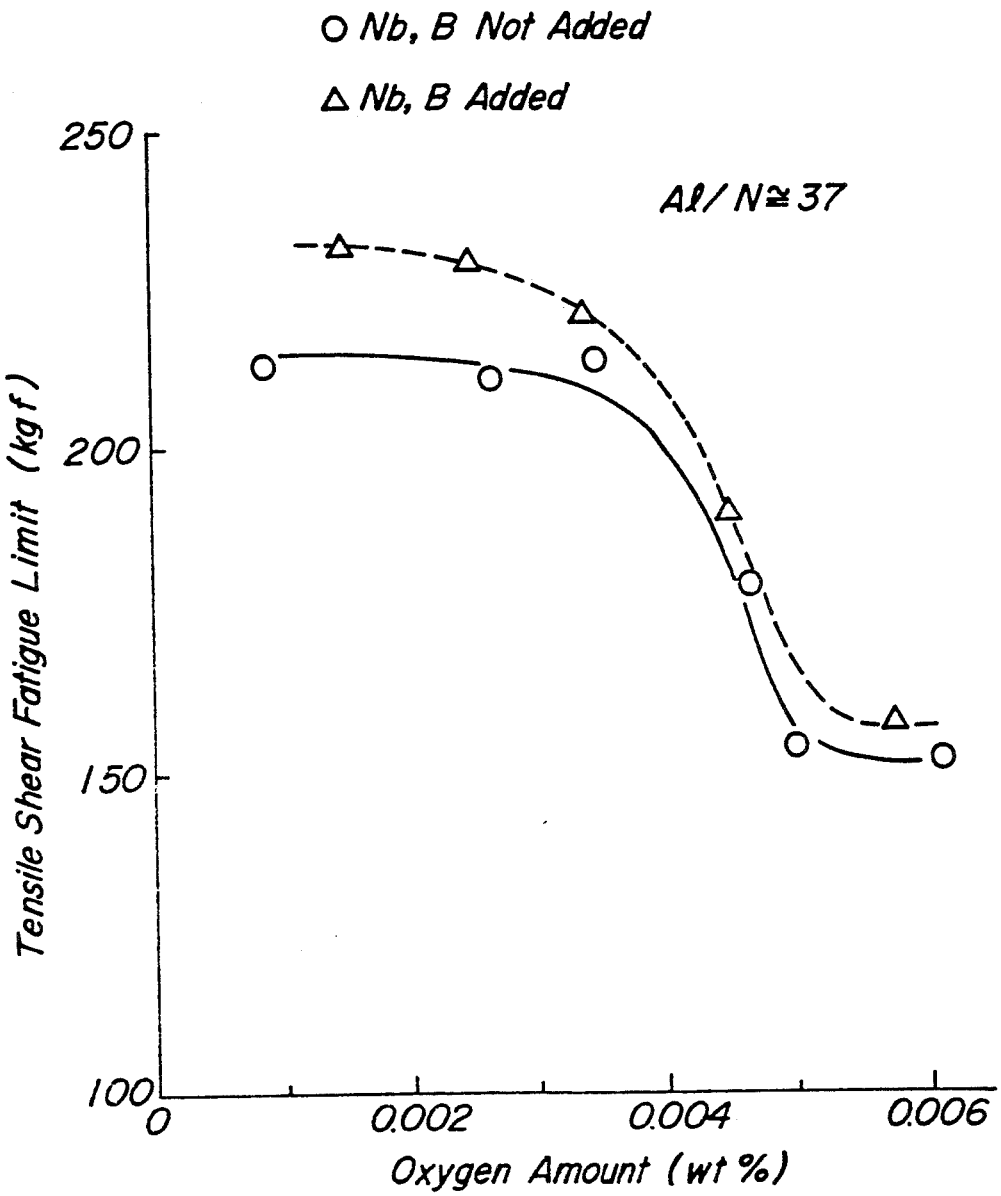
FIG. 3 is a graph showing an influence of oxygen amount upon the value of tensile shear fatigue limit in the spot welded joint when Al/N ratio of the hot rolled steel sheet is about 37.

In FIG. 3 is shown a relationship between tensile shear fatigue limit value and oxygen amount when the Al/N ratio is about 37, from which it is clear that the fatigue limit value higher than the conventional low carbon aluminum killed and hot rolled steel sheet (tensile shear fatigue limit: 168 kgf) is obtained when the O amount is not more than 0.0045 wt %.

Figure 4:
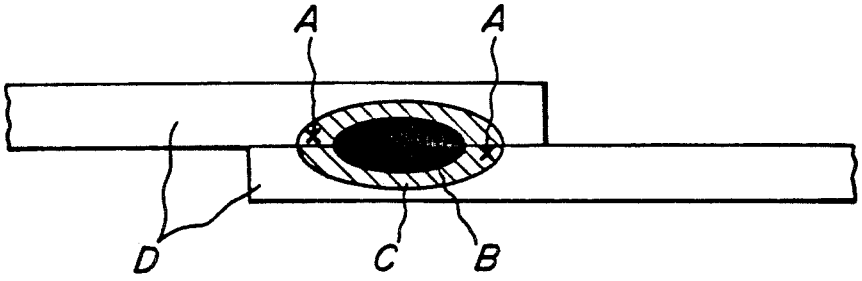
FIG. 4 is a schematically sectional view of a specimen used for tensile shear fatigue test of spot welded joint showing a position of crack produced in the fatigue test.

In these tests, the breakage due to the fatigue results from the occurrence of cracks generated at heat-affected zone as shown in FIG. 4, in which letter A is a position of crack generated, letter B a nugget portion, letter C a heat-affected zone and letter D a thin steel sheet.

In order to elucidate these reasons, the inventors have investigated a hardness distribution in a section of a welded zone on a specimen having a high fatigue limit value and found that the hardness difference ranging from the fused zone to the heat-affected zone is small as compared with the steel sheet having a low fatigue limit value and is smooth in the distribution. From this fact, it is considered that such a small hardness difference effectively acts to the occurrence of fatigue cracks and the propagation thereof due to stress concentration in the welded joint portion under stress loading.

Furthermore, it has been found from FIGS. 1-3 that the fatigue limit value becomes higher in steel sheets containing at least one of Nb and B within a proper amount.

On the other hand, a cold rolled Ti-containing steel sheet of 0.7 mm in thickness having a chemical composition as shown in the following Table 5 was welded under spot welding conditions as shown in the following Table 6, and then a cross tensile fatigue test was made thereto. In this case, the steel sheet was hot rolled at a finish temperature of about 900° C., cold rolled at a rolling reduction of 75-80% and continuously annealed at a temperature of 820°-840° C.

TABLE 5

(wt %)

| Kind of steel | C | Si | Mn | P | S | Ti | Nb | B |
|---|---|---|---|---|---|---|---|---|
| not added | 0.0009 | 0.01 | 0.1 | 0.015 | 0.01 | — | — | — |
| | 0.0018 | | | | | | | |
| Ti added steel | 0.0008 | 0.01 | 0.1 | 0.015 | 0.01 | 0.026 | — | — |
| | 0.0015 | | | | | 0.052 | | |
| Ti, Nb, B added steel | 0.0006 | 0.01 | 0.1 | 0.015 | 0.01 | 0.022 | 0.003 | 0 |
| | 0.0014 | | | | | 0.048 | 0.018 | 0.0012 |
| low carbon steel* | 0.032 | 0.02 | 0.25 | 0.018 | 0.013 | — | — | — |

*comparative steel

TABLE 6

| Sample size | | Welding conditions | | | Average nugget |
|---|---|---|---|---|---|
| width (mm) | length (mm) | chip | welding force | welding current | diameter (mm) |
| 50 | 150 | Cr—Cu, 4.5 ϕmm, CF model | 165 kgf | 7.2~7.9 kA | 4.0 |

Figure 5:
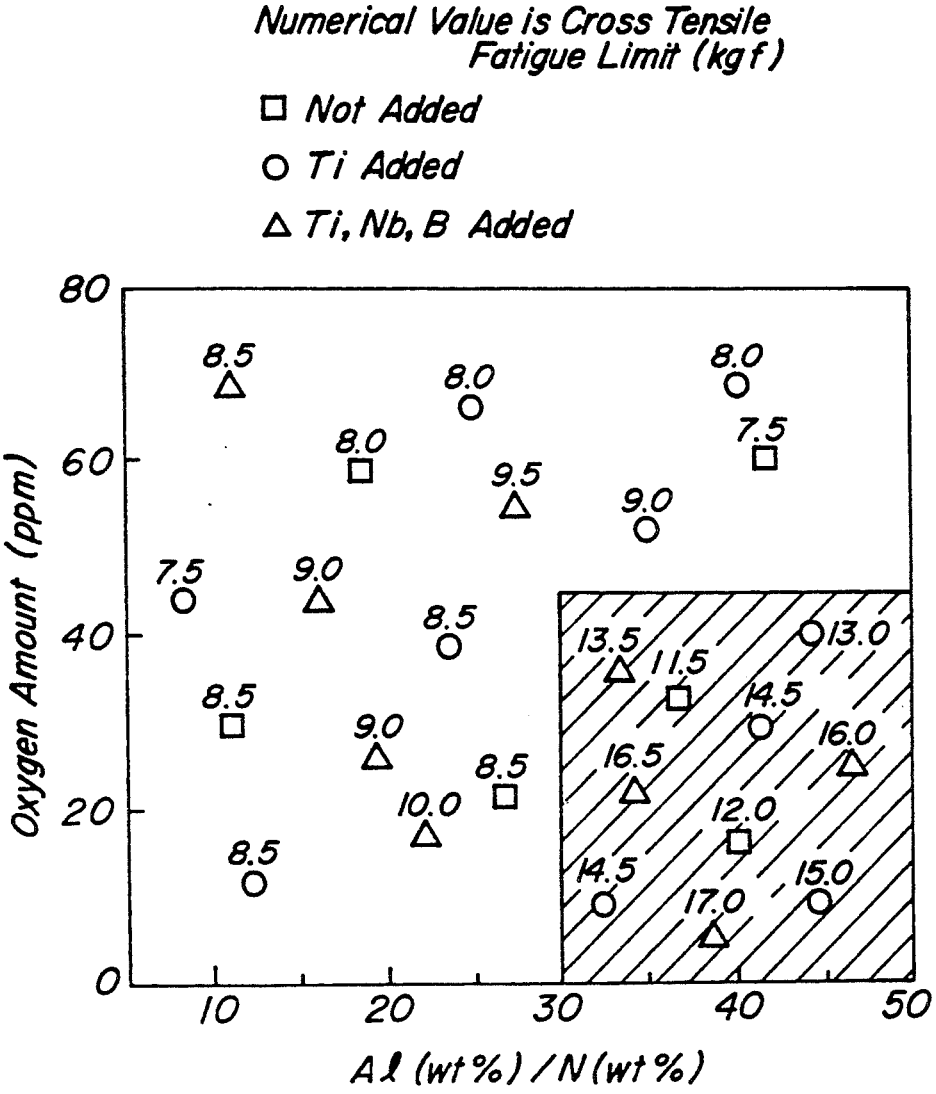
FIG. 5 is a graph showing influences of oxygen amount and Al/N ratio upon the value of cross tensile fatigue limit in the spot welded joint.

In this test, a relation of oxygen amount and Al/N ratio to the cross tensile fatigue limit value is shown in FIG. 5. From FIG. 5, it has been found that the cross tensile fatigue limit value becomes considerably high when the oxygen amount and Al/N ratio in the Ti-containing steel and Ti, Nb and B containing steel are within ranges shown by a shadowed region, that is, the oxygen amount is not more than 0.0045 wt % and the Al/N ratio is not less than 30.

Figure 6A:
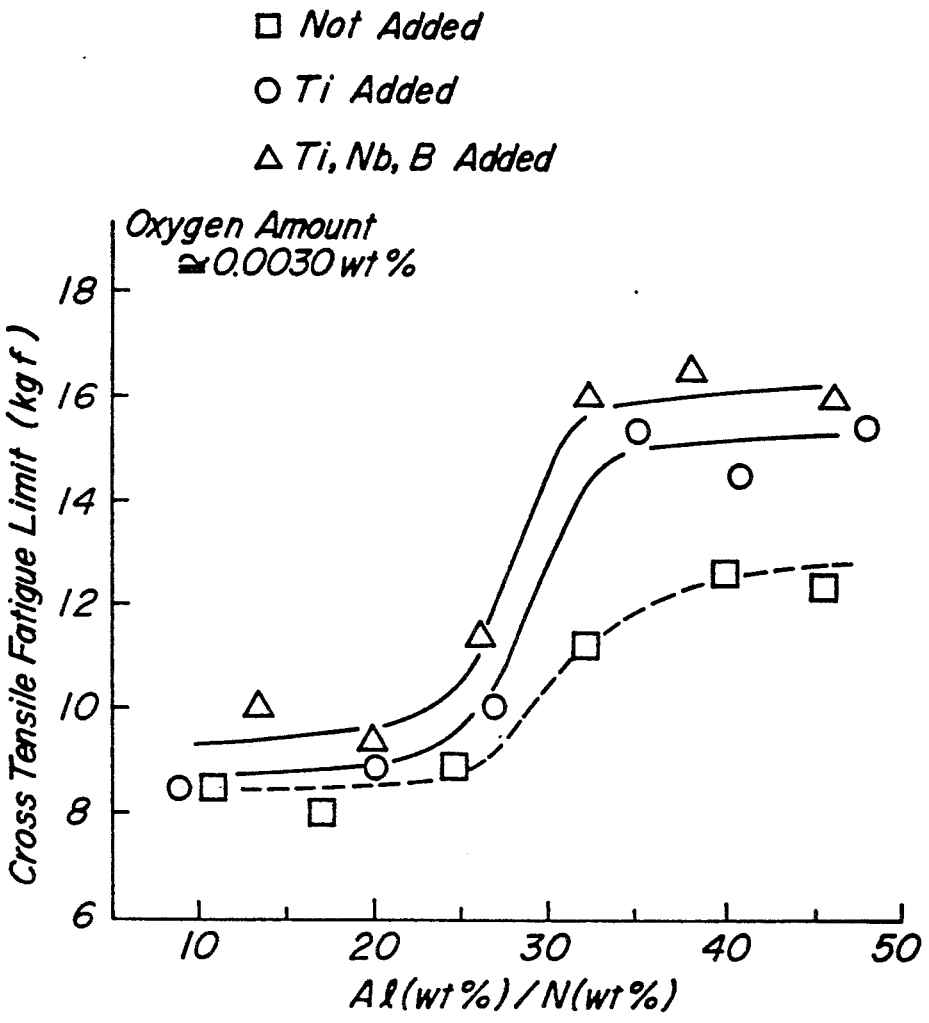
FIGS. 6*a* and 6*b* are graphs showing an influence of Al/N ratio upon values of cross tensile fatigue limit and tensile shear fatigue limit in the spot welded joint when oxygen amount is about 0.0030 wt %.
Figure 6B:
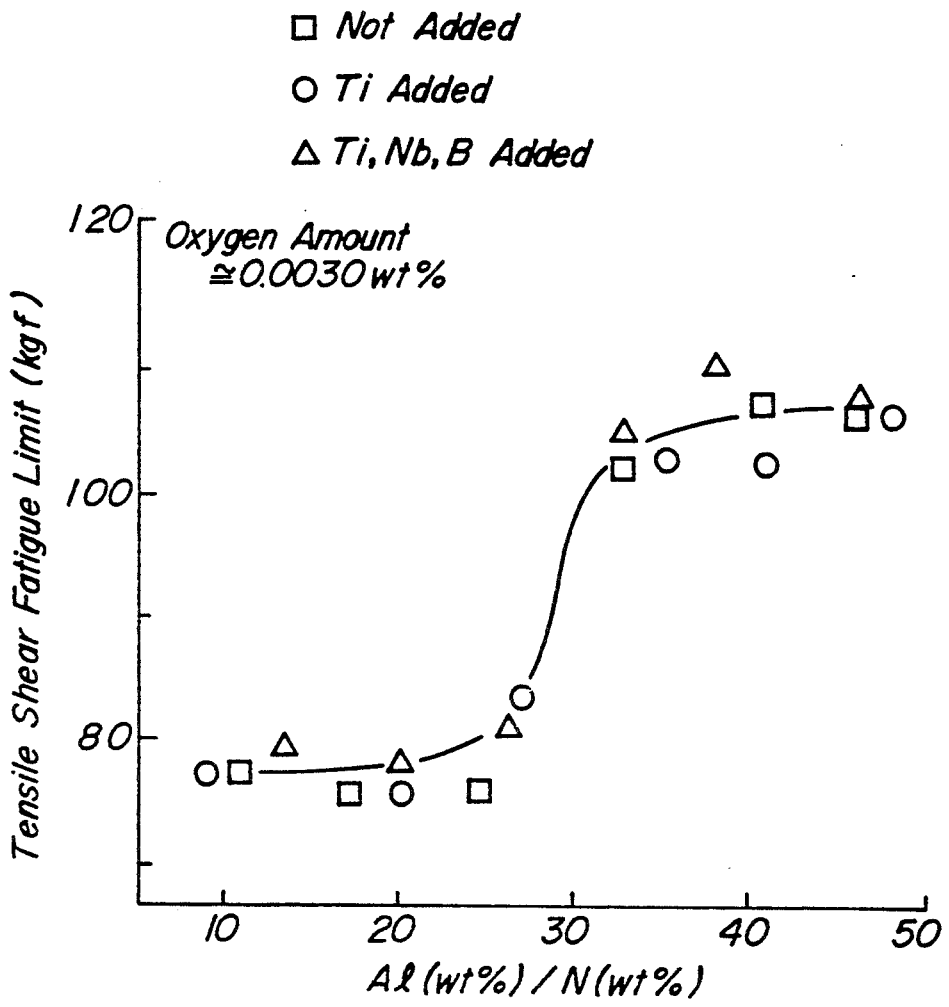

In FIG. 6*a* is shown a relationship between cross tensile fatigue limit and Al/N ratio when the oxygen amount is 0.0030 wt %. As seen from FIG. 6*a*, in the Ti-containing steel and Ti-Nb-B containing steel, the high fatigue limit value is obtained when the Al/N ratio is not less than 30. Furthermore, it is understood from the simultaneously conducted tensile shear fatigue test that the addition of Ti or Ti-Nb-B does not affect the fatigue limit as shown in FIG. 6*b*.

Moreover, similar results are obtained in the hot rolled steel sheets.

The reason why the excellent cross tensile fatigue limit value is obtained under the above conditions is considered as follows. That is, the breakage due to fatigue is led from the cracks generated at the heat-affected zone even in the cross tensile fatigue test. In case of Ti-containing steel, it is considered that the solid soluted Ti or Ti series precipitate acts to improve the toughness of the heat-affected zone, whereby the cross tensile fatigue properties are improved.

And also, it has been found that the similar effect is obtained by adding at least two of Ti, V, Zr, Ca, Cr, Cu and Ni within proper ranges in addition to the steel containing only Ti.

Figure 7A:
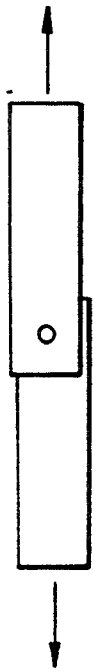
FIGS. 7*a* and 7*b* are schematic views showing modes of spot welded specimen in the tensile shear fatigue test and cross tensile fatigue test, respectively.
Figure 7B:
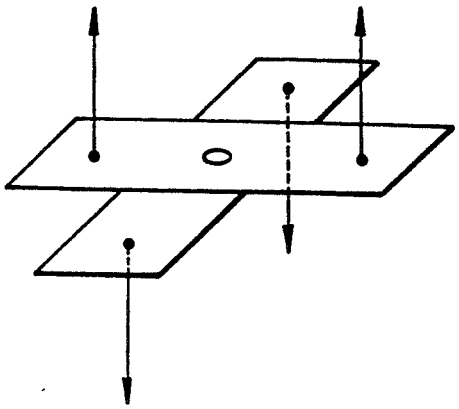

For the reference, the methods of tensile shear and cross tensile fatigue tests using spot welded specimens are schematically shown in FIGS. 7*a* and 7*b*, respectively. As seen from FIGS. 7*a* and 7*b*, the deformation mode is largely different between both the test methods.

The reason why the chemical composition of the steel used in the invention is limited to the above range will be described below.

C: The C amount should be considerably lower than that of the conventional low carbon steel in order to obtain steels having good elongation and r-value. Furthermore, the fatigue resistance becomes advantageously improved as the C amount reduces in the steel according to the invention. Therefore, the C amount is not more than 0.003 wt %, preferably not more than 0.0015 wt %.

Si: The Si amount should be not more than 1.0 wt % because when the amount exceeds 1.0 wt %, the elongation and drawability of the steel sheet are degraded.

Mn: The excessive addition of Mn degrades the elongation and drawability of the steel sheet likewise Si, so that the Mn amount should be not more than 1.0 wt %.

P: When the P amount exceeds 0.15 wt %, P segregates into the grain boundary to cause brittleness, so that it should be not more than 0.15 wt %.

S: When the S amount is too small, the descaling property is degraded to make the surface properties bad, so that the lower limit is 0.0035 wt %. While, when the amount exceeds 0.020 wt %, the corrosion resistance is considerably degraded, so that the upper limit is 0.020 wt %.

O: The O amount is particularly important in the invention because it is considered that O at solid soluted state or in form of oxide affects the occurrence and propagation of cracks. Therefore, in order to obtain the fatigue properties higher than those of the conventional low carbon steel sheet, the O amount is necessary to be not more than 0.0045 wt %. Preferably, it is not more than 0.0035 wt %.

N: As the N amount becomes larger, the Al amount required becomes excessive to degrade the surface properties as mentioned later. Therefore, the N amount is not more than 0.0020 wt %, preferably not more than 0.0017 wt %.

Al: The Al amount is also important in the invention because it is considered that the fatigue properties are improved by an influence of distribution state of solid soluted Al or AlN precipitate upon the structure of the heat-affected zone. Therefore, it is closely related to the N amount. In order to improve the fatigue properties of the welded joint, it is required to have Al (wt %)/N (wt %) ratio of not less than 30. Moreover, when the Al amount is too large, the surface properties are degraded, so that the upper limit is 0.15 wt %.

Nb, B: These elements are effective for the improvement of fatigue properties, but when the amount to be added becomes excessive, the recrystallization temperature undesirably rises. Therefore, at least one of Nb and B may be added within ranges of 0.001 wt % ≦ Nb ≦ 0.025 wt % and 0.0002 wt % ≦ B ≦ 0.0020 wt %, respectively, for improving the fatigue properties.

Ti, V, Zr, Ca, Cr, Cu, Ni: It is considered that each of these elements affects the structure of the heat-affected zone at a solid solution state or a precipitate state to enhance the fatigue properties. However, the excessive addition degrades the quality of the steel sheet. Therefore, at least one of Ti, V, Zr, Ca, Cr, Cu and Ni may be added within ranges of not more than 0.10 wt % in each of Ti, V, Zr and Ca and not more than 1.0 wt % in each of Cr, Cu and Ni, respectively, for particularly improving the cross tensile fatigue properties.

The invention will be described below with respect to preferable conditions in the production of formable thin steel sheets using the above chemical composition of steel as a starting material.

In the production of hot rolled steel sheets, the finish temperature is limited to not lower than 600° C. because when the finish temperature in the hot rolling is lower than 600° C., the deep drawability is degraded. Furthermore, the coiling temperature is limited to not lower than 200° C. because when the coiling temperature is lower than 200° C., the quality is degraded.

In the production of cold rolled steel sheets, the finish temperature at the hot rolling step is not lower than 600° C., preferably not lower than 800° C. because when it is lower than 600° C., the deep drawability is degraded. Furthermore, the rolling reduction at the cold rolling step is not less than 60% in order to obtain a satisfactory formability. Moreover, the annealing temperature at the continuous annealing step after the cold rolling is not higher than $A_{C3}$ point because when it is higher than $A_{C3}$ point, the crystal grains become coarse. Particularly, the lower limit of the annealing temperature is not critical, but it is preferably higher by 30° C. than the recrystallization temperature. As the annealing method, a box annealing may be used.

Of course, these thin steel sheets may be subjected to a skin pass rolling within a usual range, i.e. about few percent of the sheet gauge (mm) for correcting the sheet shape and the like.

Even if the thin steel sheet is subjected to a galvanizing or an electroplating, the breakage in the fatigue test is generated from the heat-affected zone, so that according to the invention, the thin steel sheet may be subsequently subjected to a surface treatment such as galvanizing, electroplating or the like.

As the welding method, the fatigue strength in the heat-affected zone comes into problem in MIG method, TIG method and the like in addition to the spot welding, so that the invention is effective for improving the fatigue strength of welded joint even in these welding methods.

The following examples are given in illustration of the invention and are not intended as limitations thereof.

EXAMPLE 1

A steel having a chemical composition as shown in the following Table 7 was melted to form a slab, which was hot rolled at a finish temperature of 850°-900° C., cold rolled at a rolling reduction of 71-78% and continuously annealed at an annealing temperature of 790°-830° C. to obtain a cold rolled steel sheet of 0.8 mm in thickness. Moreover, the steel No. 18 was the conventional low carbon aluminum killed steel and was produced by box annealing.

The steel Nos. 1-9 were acceptable in the invention, among which the steel Nos. 1 and 8 were subjected to a galvanizing and electroplating, respectively.

The steel Nos. 10-17 were comparative examples, whose chemical compositions were outside the range of the invention.

The mechanical properties and tensile shear fatigue limit value at spot welded joint portion (upper limit of loading range when the repeat number of tensile loading was 10,000,000) were measured with respect to these cold rolled steel sheets to obtain results as shown in the following Table 8.

Moreover, a specimen of JIS Z2201 No. 5 was used in the tensile test, and the spot welding conditions and tensile shear fatigue test conditions were the same as in Table 2.

TABLE 7

| | Chemical composition (wt %) | | | | | | | | | |
|---|---|---|---|---|---|---|---|---|---|---|
| No. | C | Si | Mn | P | S | N | Al | O | others | Remarks |
| 1 | 0.0007 | 0.01 | 0.21 | 0.015 | 0.008 | 0.0013 | 0.051 | 0.0018 | | acceptable example |
| 2 | 0.0021 | 0.02 | 0.26 | 0.021 | 0.015 | 0.0007 | 0.075 | 0.0023 | | acceptable example |
| 3 | 0.0015 | 0.6 | 0.18 | 0.016 | 0.012 | 0.0011 | 0.066 | 0.0028 | | acceptable example |
| 4 | 0.0018 | 0.03 | 0.55 | 0.069 | 0.005 | 0.0016 | 0.062 | 0.0029 | | acceptable example |
| 5 | 0.0005 | 0.01 | 0.12 | 0.015 | 0.007 | 0.0015 | 0.055 | 0.0033 | Nb: 0.005 | acceptable example |
| 6 | 0.0008 | 0.01 | 0.12 | 0.017 | 0.016 | 0.0014 | 0.045 | 0.0021 | Nb: 0.016 | acceptable example |
| 7 | 0.0009 | 0.02 | 0.20 | 0.005 | 0.009 | 0.0009 | 0.041 | 0.0012 | B: 0.0006 | acceptable example |
| 8 | 0.0018 | 0.01 | 0.35 | 0.025 | 0.011 | 0.0012 | 0.038 | 0.0022 | Nb: 0.007<br>B: 0.0005 | acceptable example |
| 9 | 0.0008 | 0.02 | 0.26 | 0.022 | 0.018 | 0.0016 | 0.062 | 0.0032 | Nb: 0.018<br>B: 0.0017 | acceptable example |
| 10 | 0.0022 | 0.01 | 0.15 | 0.012 | 0.009 | 0.0017 | 0.023 | 0.0034 | | comparative example |

TABLE 7-continued

| No. | Chemical composition (wt %) C | Si | Mn | P | S | N | Al | O | others | Remarks |
|---|---|---|---|---|---|---|---|---|---|---|
| 11 | 0.0014 | 0.01 | 0.16 | 0.013 | 0.011 | 0.0022 | 0.070 | 0.0029 | | comparative example |
| 12 | 0.0016 | 0.02 | 0.14 | 0.015 | 0.012 | 0.0014 | 0.048 | 0.0053 | | comparative example |
| 13 | 0.0033 | 0.03 | 0.23 | 0.015 | 0.004 | 0.0012 | 0.080 | 0.0042 | | comparative example |
| 14 | 0.0016 | 1.12 | 0.10 | 0.022 | 0.004 | 0.0015 | 0.075 | 0.0036 | | comparative example |
| 15 | 0.0022 | 0.02 | 1.21 | 0.026 | 0.006 | 0.0019 | 0.069 | 0.0029 | | comparative example |
| 16 | 0.0022 | 0.01 | 0.23 | 0.022 | 0.009 | 0.0015 | 0.081 | 0.0019 | Nb: 0.027 | comparative example |
| 17 | 0.0015 | 0.01 | 0.16 | 0.009 | 0.006 | 0.0016 | 0.062 | 0.0035 | B: 0.0026 | comparative example |
| 18 | 0.0350 | 0.01 | 0.16 | 0.015 | 0.016 | 0.0042 | 0.035 | 0.0056 | | conventional example |

TABLE 8

| No. | Surface treatment | Y.S. kg/mm² | T.S. kg/mm² | El. % | r-value | S-FL kgf | Remarks |
|---|---|---|---|---|---|---|---|
| 1a | none | 16.2 | 30.5 | 51.0 | 2.02 | 125.6 | acceptable example |
| 1b | galvanizing | 17.8 | 32.0 | 49.2 | 1.90 | 116.7 | acceptable example |
| 1c | zinc electroplating | 17.5 | 31.4 | 49.8 | 1.95 | 126.5 | acceptable example |
| 2 | none | 17.2 | 31.5 | 49.0 | 1.91 | 114.0 | acceptable example |
| 3 | " | 19.6 | 32.9 | 46.5 | 1.92 | 105.8 | acceptable example |
| 4 | " | 19.2 | 36.6 | 44.1 | 1.91 | 122.5 | acceptable example |
| 5 | " | 15.6 | 29.8 | 53.0 | 2.21 | 135.5 | acceptable example |
| 6 | " | 15.9 | 30.2 | 52.5 | 2.16 | 132.2 | acceptable example |
| 7 | " | 16.8 | 31.0 | 52.2 | 2.18 | 130.5 | acceptable example |
| 8a | " | 17.5 | 30.2 | 51.6 | 2.06 | 154.5 | acceptable example |
| 8b | galvanizing | 18.7 | 31.8 | 50.2 | 1.92 | 142.5 | acceptable example |
| 8c | zinc electroplating | 18.3 | 31.5 | 50.8 | 1.95 | 147.0 | acceptable example |
| 9 | none | 20.1 | 31.6 | 48.1 | 1.86 | 145.4 | acceptable example |
| 10 | " | 18.7 | 30.2 | 45.8 | 1.71 | 78.8 | comparative example |
| 11 | " | 17.5 | 31.2 | 47.2 | 1.72 | 82.6 | comparative example |
| 12 | " | 19.2 | 31.0 | 47.0 | 1.67 | 83.2 | comparative example |
| 13 | " | 21.2 | 32.1 | 45.0 | 1.60 | 86.5 | comparative example |
| 14 | " | 26.0 | 37.2 | 37.0 | 1.38 | 82.5 | comparative example |
| 15 | " | 23.9 | 36.2 | 38.1 | 1.52 | 80.5 | comparative example |
| 16 | " | 21.2 | 32.1 | 45.0 | 1.60 | 83.4 | comparative example |
| 17 | " | 22.0 | 31.8 | 44.0 | 1.38 | 85.4 | comparative example |
| 18 | " | 18.8 | 31.9 | 45.0 | 1.72 | 82.2 | conventional example |

S-FL: tensile shear fatigue limit

As seen from Table 8, all of the steels according to the invention exhibit good mechanical properties and tensile shear fatigue limit value, while the comparative steels and the conventional steel are poor in either the mechanical properties or the tensile shear fatigue limit value.

Furthermore, the surface treated steels according to the invention are naturally excellent in the properties as compared with the comparative and conventional steels because the breakage in the fatigue test is generated from the heat-affected zone.

Moreover, in the steel Nos. 5-9 containing either Nb or B or both, the fatigue resistance at the heat-affected zone is further improved, so that they exhibit a higher tensile shear fatigue limit value among the steels according to the invention.

EXAMPLE 2

A steel having a chemical composition as shown in the following Table 9 was melted to form a slab, which was hot rolled at a finish temperature of 830°-900° C. and would at a coiling temperature of 550°-650° C. to obtain a hot rolled steel sheet of 2.6 mm in thickness.

The steel Nos. 1-9 were acceptable in the invention, among which the steel Nos. 2 and 8 were subjected to a galvanizing and electroplating, respectively.

The steel Nos. 10-17 were comparative examples, whose chemical compositions were outside the range of the invention, and the steel No. 18 was the conventional low carbon aluminum killed steel.

The mechanical properties and tensile shear fatigue limit value at spot welded joint portion (upper limit of loading range when the repeat number of tensile loading was 10,000,000) were measured with respect to these hot rolled steel sheets to obtain results as shown in the following Table 10.

Moreover, a specimen of JIS Z2201 No. 5 was used in the tensile test, and the spot welding conditions and tensile shear fatigue test conditions were the same as in Table 4.

TABLE 9

| No. | Chemical composition (wt %) C | Si | Mn | P | S | N | Al | O | others | Al/N | Remarks |
|---|---|---|---|---|---|---|---|---|---|---|---|
| 1 | 0.0008 | 0.01 | 0.20 | 0.015 | 0.008 | 0.0012 | 0.050 | 0.0016 | | 41.7 | acceptable example |
| 2 | 0.0013 | 0.02 | 0.21 | 0.020 | 0.015 | 0.0009 | 0.070 | 0.0023 | | 77.8 | acceptable example |
| 3 | 0.0015 | 0.50 | 0.26 | 0.016 | 0.010 | 0.0014 | 0.066 | 0.0023 | | 47.1 | acceptable example |
| 4 | 0.0010 | 0.03 | 0.60 | 0.056 | 0.005 | 0.0015 | 0.060 | 0.0030 | | 40.0 | acceptable example |
| 5 | 0.0006 | 0.02 | 0.12 | 0.015 | 0.007 | 0.0015 | 0.055 | 0.0020 | Nb: 0.006 | 36.7 | acceptable example |
| 6 | 0.0025 | 0.01 | 0.12 | 0.017 | 0.016 | 0.0014 | 0.045 | 0.0033 | Nb: 0.013 | 32.1 | acceptable example |
| 7 | 0.0009 | 0.02 | 0.20 | 0.005 | 0.009 | 0.0009 | 0.041 | 0.0012 | B: 0.0005 | 45.6 | acceptable example |
| 8 | 0.0013 | 0.01 | 0.35 | 0.025 | 0.011 | 0.0012 | 0.038 | 0.0022 | Nb: 0.008 B: 0.0005 | 31.7 | acceptable example |
| 9 | 0.0008 | 0.02 | 0.26 | 0.022 | 0.010 | 0.0014 | 0.056 | 0.0022 | Nb: 0.018 B: 0.0017 | 40.0 | acceptable example |
| 10 | 0.0012 | 0.01 | 0.15 | 0.012 | 0.009 | 0.0017 | 0.020 | 0.0034 | | 11.8 | comparative example |
| 11 | 0.0014 | 0.01 | 0.10 | 0.014 | 0.011 | 0.0022 | 0.070 | 0.0029 | | 31.8 | comparative example |
| 12 | 0.0016 | 0.02 | 0.14 | 0.015 | 0.015 | 0.0014 | 0.048 | 0.0055 | | 34.3 | comparative example |
| 13 | 0.0035 | 0.03 | 0.23 | 0.015 | 0.016 | 0.0012 | 0.080 | 0.0040 | | 66.7 | comparative example |
| 14 | 0.0016 | 1.10 | 0.10 | 0.022 | 0.013 | 0.0015 | 0.075 | 0.0023 | | 50.0 | comparative example |
| 15 | 0.0013 | 0.02 | 1.25 | 0.026 | 0.006 | 0.0019 | 0.069 | 0.0029 | | 36.3 | comparative example |
| 16 | 0.0012 | 0.01 | 0.23 | 0.022 | 0.009 | 0.0015 | 0.081 | 0.0019 | Nb: 0.028 | 54.0 | comparative example |
| 17 | 0.0008 | 0.01 | 0.16 | 0.009 | 0.006 | 0.0016 | 0.062 | 0.0025 | B: 0.0026 | 38.8 | comparative example |
| 18 | 0.036 | 0.01 | 0.26 | 0.018 | 0.016 | 0.0050 | 0.035 | 0.0056 | | 7.0 | comventional example |

TABLE 10

| No. | Surface treatment | Y.S. kg/mm² | T.S. kg/mm² | El. % | S-FL kgf | Remarks |
|---|---|---|---|---|---|---|
| 1 | none | 16.8 | 31.5 | 54.0 | 208 | acceptable example |
| 2a | " | 16.5 | 30.2 | 54.7 | 210 | acceptable example |
| 2b | galvanizing | 17.5 | 31.8 | 52.0 | 204 | acceptable example |
| 2c | zinc electroplating | 17.1 | 31.5 | 52.7 | 208 | acceptable example |
| 3 | none | 19.2 | 33.9 | 50.5 | 218 | acceptable example |
| 4 | " | 20.5 | 37.8 | 48.1 | 210 | acceptable example |
| 5 | " | 15.0 | 29.6 | 56.0 | 232 | acceptable example |
| 6 | " | 15.7 | 31.2 | 56.3 | 228 | acceptable example |
| 7 | " | 16.8 | 32.0 | 54.5 | 220 | acceptable example |
| 8a | " | 18.5 | 31.7 | 54.6 | 236 | acceptable example |
| 8b | galvanizing | 20.1 | 32.5 | 52.2 | 223 | acceptable example |
| 8c | zinc electroplating | 19.7 | 31.9 | 52.8 | 238 | acceptable example |
| 9 | none | 20.4 | 32.2 | 50.6 | 220 | acceptable example |
| 10 | " | 18.8 | 30.8 | 49.7 | 160 | comparative example |
| 11 | " | 18.5 | 32.5 | 50.2 | 172 | comparative example |
| 12 | " | 19.6 | 31.6 | 51.0 | 166 | comparative example |
| 13 | " | 21.8 | 33.4 | 48.8 | 178 | comparative example |
| 14 | " | 26.0 | 37.8 | 43.2 | 176 | comparative example |
| 15 | " | 24.9 | 36.9 | 45.1 | 181 | comparative example |
| 16 | " | 23.2 | 32.8 | 49.1 | 166 | comparative example |
| 17 | " | 23.5 | 32.8 | 48.0 | 172 | comparative example |

TABLE 10-continued

| No. | Surface treatment | Y.S. kg/mm² | T.S. kg/mm² | El. % | S-FL kgf | Remarks |
|---|---|---|---|---|---|---|
| 18 | " | 20.6 | 32.9 | 51.1 | 175 | conventional example |

S-FL: tensile shear fatigue limit

As seen from Table 10, all of the steels according to the invention exhibit good mechanical properties and tensile shear fatigue limit value, while the comparative steels and the conventional steel are poor in either the mechanical properties or the tensile shear fatigue limit value.

Furthermore, the surface treated steels according to the invention are naturally excellent in the properties as compared with the comparative and conventional steels because the breakage in the fatigue test is generated from the heat-affected zone.

Moreover, in the steel Nos. 5–9 containing either Nb or B or both, the fatigue resistance at the heat-affected zone is further improved, so that they exhibit a higher tensile shear fatigue limit value among the steels according to the invention.

EXAMPLE 3

A steel having a chemical composition as shown in the following Table 11 was melted to form a slab, which was subjected to the following treatments under production conditions as shown in the following Table 12.

The hot rolled steel sheet of 2.6 mm in thickness was produced by subjecting the slab at a finish temperature of 830°–900° C. and winding at a coiling temperature of 550°–650° C.

On the other hand, the slab was hot rolled at a finish temperature of 830°–920° C. and coiled at a coiling temperature of 550°–650° C. to obtain a hot rolled sheet of 3.2 mm in thickness. Then, the hot rolled sheet was cold rolled to a thickness of 0.7 mm at a rolling reduction of 78%, annealed at 750°–880° C. and further subjected to a skin pass rolling at 0.7%.

Furthermore, a part of the hot rolled steel sheets and cold rolled steel sheets was subjected to a galvanizing or electroplating.

The steel Nos. 1–14 and Nos. 26–36 were acceptable in the invention, and the steel Nos. 15–24 and Nos. 37–43 were comparative examples, whose chemical compositions were outside the range of the invention. Moreover, the steel Nos. 25 and 44 were the conventional low carbon aluminum killed steel, in which the steel No. 25 was produced by box annealing.

The mechanical properties and cross tensile fatigue limit value at spot welded joint portion (upper limit of loading range when the repeat number of tensile loading was 10,000,000) were measured with respect to these thin steel sheets to obtain results as shown in Table 12.

Moreover, a specimen of JIS Z2201 No. 5 was used in the tensile test, and the spot welding conditions and cross tensile fatigue test conditions were the same as in Table 6 in case of the cold rolled steel sheets and were carried out under conditions as shown in the following Table 13 in case of the hot rolled steel sheets.

TABLE 11

| No. | Chemical composition (wt %) C | Si | Mn | P | S | Al | N | O | others | Al/N | Remarks |
|---|---|---|---|---|---|---|---|---|---|---|---|
| 1 | 0.0008 | 0.01 | 0.11 | 0.012 | 0.008 | 0.049 | 0.0014 | 0.0023 | Ti: 0.031 | 35.0 | acceptable example |
| 2 | 0.0012 | 0.01 | 0.08 | 0.012 | 0.010 | 0.062 | 0.0016 | 0.0029 | Ti: 0.035 | 38.8 | acceptable example |
| 3 | 0.0011 | 0.01 | 0.17 | 0.010 | 0.009 | 0.071 | 0.0020 | 0.0032 | V: 0.063 | 35.5 | acceptable example |
| 4 | 0.0012 | 0.02 | 0.22 | 0.020 | 0.009 | 0.038 | 0.0010 | 0.0026 | Cr: 0.58 | 38.0 | acceptable example |
| 5 | 0.0015 | 0.01 | 0.14 | 0.018 | 0.013 | 0.061 | 0.0018 | 0.0032 | Cu: 0.83 | 33.9 | acceptable example |
| 6 | 0.0007 | 0.01 | 0.13 | 0.015 | 0.012 | 0.047 | 0.0012 | 0.0028 | Ti: 0.025, V: 0.016, Cr: 0.35 | 39.2 | acceptable example |
| 7 | 0.0012 | 0.02 | 0.15 | 0.012 | 0.015 | 0.063 | 0.0019 | 0.0032 | Ti: 0.018, Zr: 0.041, Cu: 0.56 | 33.2 | acceptable example |
| 8 | 0.0013 | 0.01 | 0.15 | 0.018 | 0.008 | 0.067 | 0.0020 | 0.0035 | V: 0.042, Ca: 0.013, Cr: 0.31, Ni: 0.25 | 33.5 | acceptable example |
| 9 | 0.0015 | 0.01 | 0.11 | 0.012 | 0.010 | 0.059 | 0.0017 | 0.0028 | Ti: 0.017, V: 0.031, Zr: 0.018, Cr: 0.14, Cu: 0.35 | 34.7 | acceptable example |
| 10 | 0.0009 | 0.01 | 0.15 | 0.011 | 0.009 | 0.042 | 0.0011 | 0.0025 | Ti: 0.028, Nb: 0.005 | 38.2 | acceptable example |
| 11 | 0.0008 | 0.02 | 0.18 | 0.010 | 0.007 | 0.058 | 0.0015 | 0.0032 | Ti: 0.033, B: 0.0004 | 38.7 | acceptable example |
| 12 | 0.0006 | 0.01 | 0.15 | 0.021 | 0.009 | 0.068 | 0.0019 | 0.0035 | Ti: 0.027, Nb: 0.003, B: 0.0003 | 35.8 | acceptable example |
| 13 | 0.0012 | 0.02 | 0.15 | 0.010 | 0.011 | 0.050 | 0.0013 | 0.0021 | V: 0.052, Nb: 0.012, B: 0.0005 | 38.5 | acceptable example |
| 14 | 0.0014 | 0.01 | 0.14 | 0.012 | 0.008 | 0.061 | 0.0017 | 0.0027 | Zr: 0.069, Cr: 0.37, Ni: 0.28, Nb: 0.007 | 35.9 | acceptable example |
| 15 | 0.0024 | 0.02 | 0.20 | 0.015 | 0.010 | 0.055 | 0.0018 | 0.0035 | Ti: 0.12 | 30.6 | comparative example |
| 16 | 0.0013 | 0.01 | 0.20 | 0.018 | 0.015 | 0.059 | 0.0018 | 0.0079 | Ti: 0.024, B: 0.0007 | 32.8 | comparative example |
| 17 | 0.0018 | 0.02 | 0.14 | 0.023 | 0.012 | 0.038 | 0.0038 | 0.0033 | Ti: 0.042 | 10.0 | comparative example |
| 18 | 0.0025 | 0.01 | 0.18 | 0.018 | 0.012 | 0.015 | 0.0016 | 0.0035 | V: 0.023 | 9.4 | comparative example |
| 19 | 0.0013 | 0.02 | 0.12 | 0.017 | 0.012 | 0.060 | 0.0019 | 0.0033 | Zr: 0.17 | 31.6 | comparative example |
| 20 | 0.0010 | 0.02 | 1.2 | 0.010 | 0.020 | 0.055 | 0.0018 | 0.0030 | Ca: 0.089 | 30.6 | comparative example |

TABLE 11-continued

| No. | Chemical composition (wt %) C | Si | Mn | P | S | Al | N | O | others | Al/N | Remarks |
|---|---|---|---|---|---|---|---|---|---|---|---|
| 21 | 0.0012 | 0.02 | 0.13 | 0.012 | 0.010 | 0.081 | 0.0018 | 0.0089 | Cu: 1.15 | 45.0 | comparative example |
| 22 | 0.0048 | 0.01 | 0.15 | 0.012 | 0.015 | 0.056 | 0.0017 | 0.0028 | Ti: 0.037, Cr: 0.57, Ni: 0.42 | 32.9 | comparative example |
| 23 | 0.0014 | 0.02 | 0.12 | 0.010 | 0.018 | 0.11 | 0.0032 | 0.0032 | V: 0.026, Ca: 0.020, Cr: 0.32, Ni: 0.73 | 34.4 | Comparative example |
| 24 | 0.0018 | 0.01 | 0.21 | 0.018 | 0.012 | 0.068 | 0.0019 | 0.0026 | Zr: 0.052, Ca: 0.041, Cr: 0.42, Cu: 0.41, Ni: 2.3 | 35.8 | Comparative example |
| 25 | 0.036 | 0.01 | 0.26 | 0.018 | 0.016 | 0.035 | 0.0050 | 0.0056 | | 7.0 | conventional example |
| 26 | 0.0006 | 0.01 | 0.09 | 0.012 | 0.010 | 0.053 | 0.0015 | 0.0032 | Ti: 0.035 | 35.3 | acceptable example |
| 27 | 0.0007 | 0.02 | 0.12 | 0.015 | 0.007 | 0.040 | 0.0011 | 0.0027 | Zr: 0.085 | 36.4 | acceptable example |
| 28 | 0.0013 | 0.02 | 0.18 | 0.025 | 0.010 | 0.058 | 0.0015 | 0.0031 | Ca: 0.027 | 38.7 | acceptable example |
| 29 | 0.0014 | 0.02 | 0.12 | 0.015 | 0.012 | 0.049 | 0.0012 | 0.0030 | Ni: 0.33 | 40.8 | acceptable example |
| 30 | 0.0008 | 0.01 | 0.15 | 0.012 | 0.015 | 0.060 | 0.0017 | 0.0025 | Ti: 0.028, V: 0.015, Cr: 0.38 | 35.3 | acceptable example |
| 31 | 0.0010 | 0.01 | 0.15 | 0.015 | 0.010 | 0.056 | 0.0018 | 0.0035 | Zr: 0.063, Cr: 0.33, Cu: 0.45 | 31.1 | acceptable example |
| 32 | 0.0009 | 0.02 | 0.10 | 0.010 | 0.012 | 0.071 | 0.0018 | 0.0012 | Ti: 0.025, Zr: 0.023, Ca: 0.018, Cr: 0.41 | 39.4 | acceptable example |
| 33 | 0.0013 | 0.01 | 0.12 | 0.012 | 0.008 | 0.068 | 0.0020 | 0.0028 | V: 0.045, Zr: 0.020, Ca: 0.027, Cu: 0.32, Ni: 0.43 | 34.0 | acceptable example |
| 34 | 0.0015 | 0.01 | 0.15 | 0.015 | 0.012 | 0.047 | 0.0012 | 0.0034 | Ti: 0.032, Cr: 0.30, Nb: 0.006 | 39.2 | acceptable example |
| 35 | 0.0010 | 0.02 | 0.12 | 0.012 | 0.009 | 0.055 | 0.0017 | 0.0030 | Ti: 0.033, Nb: 0.007, B: 0.0006 | 32.4 | acceptable example |
| 36 | 0.0009 | 0.01 | 0.20 | 0.010 | 0.009 | 0.051 | 0.0015 | 0.0028 | V: 0.042, Nb: 0.013, B: 0.0005 | 34.0 | acceptable example |
| 37 | 0.0041 | 0.02 | 0.15 | 0.010 | 0.014 | 0.078 | 0.0020 | 0.0029 | Ti: 0.015 | 39.0 | comparative example |
| 38 | 0.0029 | 0.01 | 0.17 | 0.015 | 0.010 | 0.062 | 0.0018 | 0.0033 | Ti: 0.13 | 34.4 | comparative example |
| 39 | 0.0015 | 0.03 | 0.23 | 0.013 | 0.011 | 0.072 | 0.0015 | 0.0033 | Cr: 2.2 | 48.0 | comparative example |
| 40 | 0.0013 | 0.02 | 0.10 | 0.018 | 0.010 | 0.17 | 0.0020 | 0.0025 | Ni: 0.87 | 85.0 | comparative example |
| 41 | 0.0015 | 0.01 | 0.20 | 0.012 | 0.020 | 0.061 | 0.0078 | 0.0032 | V: 0.042, Zr: 0.028, Cu: 0.37 | 7.8 | comparative example |
| 42 | 0.0011 | 0.02 | 0.15 | 0.010 | 0.015 | 0.058 | 0.0018 | 0.0072 | Zr: 0.067, Ca: 0.028, Cr: 0.41, Cu: 0.37 | 32.2 | comparative example |
| 43 | 0.0018 | 0.02 | 0.10 | 0.015 | 0.012 | 0.071 | 0.0020 | 0.0030 | Ti: 0.021, V: 0.015, Ca: 0.023, Cr: 1.8, Ni: 0.25 | 35.5 | comparative example |
| 44 | 0.034 | 0.02 | 0.22 | 0.015 | 0.018 | 0.032 | 0.0055 | 0.0062 | — | 5.8 | conventional example |

TABLE 12

| No. | Production conditions kind of steel | surface treatment | Y.S. kgf/mm$^2$ | T.S. kgf/mm$^2$ | El % | r-value | C-FL kgf | Remarks |
|---|---|---|---|---|---|---|---|---|
| 1a | cold rolled steel sheet | none | 14.7 | 30.2 | 53.8 | 2.35 | 15.5 | acceptable example |
| 1b | cold rolled steel sheet | galvanizing | 16.2 | 31.0 | 52.7 | 2.20 | 15.0 | acceptable example |
| 1c | cold rolled steel sheet | zinc electroplating | 16.2 | 30.8 | 52.9 | 2.28 | 15.5 | acceptable example |
| 2 | cold rolled steel sheet | none | 15.1 | 31.0 | 53.2 | 2.41 | 15.0 | acceptable example |
| 3 | cold rolled steel sheet | none | 16.2 | 31.8 | 53.0 | 2.38 | 15.0 | acceptable example |
| 4 | cold rolled steel sheet | none | 20.0 | 33.2 | 51.8 | 2.13 | 15.5 | acceptable example |
| 5 | cold rolled steel sheet | none | 20.8 | 33.5 | 52.6 | 2.22 | 14.5 | acceptable example |
| 6 | cold rolled steel sheet | none | 18.5 | 32.1 | 53.5 | 2.30 | 15.0 | acceptable example |
| 7 | cold rolled steel sheet | galvanizing | 19.8 | 33.0 | 51.9 | 2.28 | 14.5 | acceptable example |
| 8 | cold rolled steel sheet | none | 21.0 | 33.8 | 52.3 | 2.17 | 15.0 | acceptable example |
| 9 | cold rolled steel sheet | zinc electroplating | 20.4 | 33.5 | 51.8 | 2.28 | 15.5 | acceptable example |
| 10 | cold rolled steel sheet | gulvanizing | 14.1 | 30.2 | 53.8 | 2.40 | 16.0 | acceptable example |
| 11 | cold rolled | none | 13.3 | 29.1 | 55.4 | 2.47 | 16.0 | acceptable |

TABLE 12-continued

| No. | Production conditions kind of steel | surface treatment | Y.S. kgf/mm² | T.S. kgf/mm² | El % | r-value | C-FL kgf | Remarks |
|---|---|---|---|---|---|---|---|---|
| | steel sheet | | | | | | | example |
| 12a | cold rolled | none | 14.7 | 31.0 | 54.2 | 2.53 | 17.0 | acceptable |
| | steel sheet | | | | | | | example |
| 12b | cold rolled | gulvanizing | 15.8 | 31.5 | 52.1 | 2.39 | 16.5 | acceptable |
| | steel sheet | | | | | | | example |
| 12c | cold rolled | zinc electroplating | 15.0 | 31.9 | 52.5 | 2.45 | 17.0 | acceptable |
| | steel sheet | | | | | | | example |
| 13 | cold rolled | gulvanizing | 16.0 | 31.2 | 54.5 | 2.50 | 16.5 | acceptable |
| | steel sheet | | | | | | | example |
| 14 | cold rolled | none | 18.7 | 33.8 | 53.7 | 2.45 | 15.5 | acceptable |
| | steel sheet | | | | | | | example |
| 15 | cold rolled | none | 20.4 | 30.2 | 48.2 | 1.47 | 11.0 | comparative |
| | steel sheet | | | | | | | example |
| 16 | cold rolled | none | 18.1 | 31.0 | 47.0 | 1.98 | 8.5 | comparative |
| | steel sheet | | | | | | | example |
| 17 | cold rolled | gulvanizing | 16.4 | 30.7 | 51.9 | 2.10 | 8.0 | comparative |
| | steel sheet | | | | | | | example |
| 18 | cold rolled | none | 17.1 | 32.7 | 49.0 | 2.02 | 7.5 | comparative |
| | steel sheet | | | | | | | example |
| 19 | cold rolled | none | 18.9 | 32.7 | 48.2 | 2.11 | 11.5 | comparative |
| | steel sheet | | | | | | | example |
| 20 | cold rolled | none | 25.0 | 36.2 | 43.6 | 1.48 | 11.5 | comparative |
| | steel sheet | | | | | | | example |
| 21 | cold rolled | gulvanizing | 22.3 | 33.9 | 51.4 | 1.55 | 8.0 | comparative |
| | steel sheet | | | | | | | example |
| 22 | cold rolled | none | 22.5 | 34.5 | 44.1 | 1.43 | 11.0 | comparative |
| | steel sheet | | | | | | | example |
| 23 | cold rolled | none | 21.8 | 35.3 | 45.7 | 1.57 | 8.0 | comparative |
| | steel sheet | | | | | | | example |
| 24 | cold rolled | zinc electroplating | 24.0 | 36.1 | 41.3 | 1.32 | 12.0 | comparative |
| | steel sheet | | | | | | | example |
| 25 | cold rolled | none | 19.8 | 32.0 | 50.8 | 1.82 | 7.5 | conventional |
| | steel sheet | | | | | | | example |
| 26a | hot rolled | none | 15.6 | 29.8 | 54.2 | | 150 | acceptable example |
| | steel sheet | | | | | | | |
| 26b | hot rolled | gulvanizing | 17.2 | 31.4 | 52.0 | | 145 | " |
| | steel sheet | | | | | | | |
| 26c | hot rolled | zinc electroplating | 16.5 | 31.0 | 52.8 | | 145 | " |
| | steel sheet | | | | | | | |
| 27 | hot rolled | gulvanizing | 18.3 | 33.8 | 52.4 | | 135 | " |
| | steel sheet | | | | | | | |
| 28 | hot rolled | none | 20.5 | 32.6 | 53.4 | | 140 | " |
| | steel sheet | | | | | | | |
| 29 | hot rolled | none | 21.8 | 33.0 | 52.2 | | 130 | " |
| | steel sheet | | | | | | | |
| 30 | hot rolled | none | 19.2 | 32.5 | 53.8 | | 150 | " |
| | steel sheet | | | | | | | |
| 31 | hot rolled | zinc electroplating | 20.5 | 33.3 | 52.1 | | 145 | " |
| | steel sheet | | | | | | | |
| 32 | hot rolled | none | 19.8 | 32.8 | 53.5 | | 140 | " |
| | steel sheet | | | | | | | |
| 33 | hot rolled | none | 22.3 | 34.0 | 52.7 | | 135 | " |
| | steel sheet | | | | | | | |
| 34 | hot rolled | gulvanizing | 17.5 | 31.4 | 53.8 | | 155 | " |
| | steel sheet | | | | | | | |
| 35a | hot rolled | none | 13.4 | 29.1 | 55.2 | | 165 | " |
| | steel sheet | | | | | | | |
| 35b | hot rolled | gulvanizing | 14.5 | 30.9 | 52.1 | | 150 | " |
| | steel sheet | | | | | | | |
| 35c | hot rolled | zinc electroplating | 14.2 | 30.5 | 53.3 | | 155 | " |
| | steel sheet | | | | | | | |
| 36 | hot rolled | none | 16.1 | 30.2 | 54.1 | | 160 | " |
| | steel sheet | | | | | | | |
| 37 | hot rolled | gulvanizing | 21.6 | 33.8 | 46.8 | | 105 | comparative example |
| | steel sheet | | | | | | | |
| 38 | hot rolled | none | 17.2 | 32.1 | 46.0 | | 105 | " |
| | steel sheet | | | | | | | |
| 39 | hot rolled | none | 25.4 | 36.7 | 47.2 | | 110 | " |
| | steel sheet | | | | | | | |
| 40 | hot rolled | none | 23.3 | 34.9 | 45.1 | | 100 | " |
| | steel sheet | | | | | | | |
| 41 | hot rolled | gulvanizing | 19.7 | 33.0 | 49.5 | | 85 | " |
| | steel sheet | | | | | | | |
| 42 | hot rolled | none | 22.5 | 35.3 | 42.7 | | 90 | " |
| | steel sheet | | | | | | | |
| 43 | hot rolled | zinc electroplating | 25.8 | 37.4 | 40.1 | | 100 | " |
| | steel sheet | | | | | | | |
| 44 | hot rolled | none | 20.3 | 33.6 | 49.3 | | 75 | conventional example |

TABLE 12-continued

| No. | Production conditions kind of steel | surface treatment | Y.S. kgf/mm² | T.S. kgf/mm² | El % | r-value | C-FL kgf | Remarks |
|---|---|---|---|---|---|---|---|---|
| | steel sheet | | | | | | | |

C-FL: cross tensile fatigue limit value

TABLE 13

| Sample size width (mm) | length (mm) | Welding conditions chip | welding force | welding current | Average nugget diameter (mm) |
|---|---|---|---|---|---|
| 50 | 150 | Cr—Cu, 8.5 ϕmm, CF model | 650 kgf | 14~17 kA | 7.8 |

As seen from Table 12, all of the steels according to the invention exhibit good mechanical properties and cross tensile fatigue limit value, while the comparative steels and the conventional steel are poor in either the mechanical properties or the cross tensile fatigue limit value.

Furthermore, the surface treated steels according to the invention are excellent in the properties as compared with the comparative and conventional steels because the breakage in the fatigue test is generated from the heat-affected zone.

Moreover, in the steel Nos. 10–14 and Nos. 34–36 containing either Nb or B or both, the fatigue resistance at the heat-affected zone is further improved, so that they exhibit a higher cross tensile fatigue limit value among the steels according to the invention.

As mentioned above, according to the invention, formable thin steel sheets having not only good formability for press forming, deep drawing or the like but also improved fatigue properties at welded joint are obtained, so that when they are applied to automobiles, structural members and the like, the prolongation of the life or the improvement of the safety is achieved.

What is claimed is:

1. A method of producing formable thin steel sheet having improved fatigue resistance at welded joints, which comprises hot rolling a sheet of steel comprising not more than 0.003 wt % of C, not more than 1.0 wt % of Si, not more than 1.0 wt % of Mn, not more than 0.15 wt % of P, not more than 0.020 wt % of S, not more than 0.0045 wt % of O, not more than 0.002 wt % of N, not more than 0.15 wt % of Al provided that a ratio of Al/N is not less than 30, and the balance being Fe and inevitable impurities at a finish temperature of not lower than 600° C., cold rolling the hot rolled sheet at a rolling reduction of not less than 60% and then subjecting the cold rolled sheet to a recrystallization annealing at a temperature of not higher than $A_{C3}$ transformation point.

2. The method according to claim 1, wherein said steel further contains at least one of 0.001–0.025 wt % of Nb and 0.0002–0.0020 wt % of B.

3. The method according to claim 1 or 2, wherein said steel further contains at least one of not more than 0.10 wt % of Ti, not more than 0.10 wt % of V, not more than 0.10 wt % of Zr, not more than 0.10 wt % of Ca, not more than 1.0 wt % of Cr, not more than 1.0 wt % of Cu and not more than 1.0 wt % of Ni.

4. The method according to claim 1, 2 or 3 wherein said hot rolled sheet is coiled at a coiling temperature of not lower than 200° C. after the hot rolling.

5. The method according to claim 1, 2, 3 or 4 wherein said thin steel sheet is subjected to a galvanizing or an electroplating.

* * * * *